US011847950B2

(12) United States Patent
Min

(10) Patent No.: US 11,847,950 B2
(45) Date of Patent: Dec. 19, 2023

(54) ELECTROLUMINESCENT DISPLAY APPARATUS AND DRIVING METHOD THEREOF

(71) Applicant: LG Display Co., Ltd., Seoul (KR)

(72) Inventor: Soon Ki Min, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/892,851

(22) Filed: Aug. 22, 2022

(65) Prior Publication Data

US 2023/0186816 A1 Jun. 15, 2023

(30) Foreign Application Priority Data

Dec. 13, 2021 (KR) ..... 10-2021-0177509

(51) Int. Cl.
*G09G 3/20* (2006.01)
*G09G 3/3233* (2016.01)

(52) U.S. Cl.
CPC ..... *G09G 3/2007* (2013.01); *G09G 3/3233* (2013.01); *G09G 2300/0819* (2013.01); *G09G 2310/0286* (2013.01); *G09G 2320/0233* (2013.01); *G09G 2320/0626* (2013.01); *G09G 2320/0673* (2013.01); *G09G 2330/021* (2013.01); *G09G 2354/00* (2013.01)

(58) Field of Classification Search
CPC .. G09G 3/2007; G09G 3/3223; G09G 3/3291; G09G 2310/0243; G09G 2320/0238; G09G 2320/0626; G09G 2320/0257; G09G 2330/021; G09G 2330/028; G09G 2360/16
See application file for complete search history.

(56) References Cited

U.S. PATENT DOCUMENTS

| | | | | |
|---|---|---|---|---|
| 10,535,294 | B2 * | 1/2020 | Giannikouris | G09G 3/3208 |
| 2019/0340981 | A1 * | 11/2019 | Pyo | G09G 3/3233 |
| 2020/0202790 | A1 * | 6/2020 | Rha | G09G 3/2003 |
| 2021/0343247 | A1 * | 11/2021 | Pyo | G09G 3/3233 |
| 2022/0319382 | A1 * | 10/2022 | Kim | G09G 3/2074 |

* cited by examiner

*Primary Examiner* — Priyank J Shah
(74) *Attorney, Agent, or Firm* — Birch, Stewart, Kolasch & Birch, LLP

(57) ABSTRACT

An electroluminescent display apparatus can include a display panel including a plurality of pixels, and a luminance adjuster. The luminance adjuster can select a target optical band corresponding to a digital brightness value from among a plurality of optical bands for differently controlling a maximum luminance of an image implemented in the display panel, and can adjust a black grayscale data voltage corresponding to the target optical band. The black grayscale data voltage can be differently set in at least two of the plurality of optical bands.

20 Claims, 14 Drawing Sheets

ELECTROLUMINESCENT DISPLAY APPARATUS AND DRIVING METHOD THEREOF

CROSS-REFERENCE TO RELATED APPLICATIONS

This application claims priority to the Korean Patent Application No. 10-2021-0177509 filed on Dec. 13, 2021 in the Republic of Korea, the entire contents of which are hereby expressly incorporated by reference into the present application.

BACKGROUND OF THE DISCLOSURE

Field of the Invention

The present disclosure relates to an electroluminescent display apparatus and a driving method thereof.

Discussion of the Related Art

Electroluminescent display apparatuses are categorized into inorganic light emitting display apparatuses and organic light emitting display apparatuses on the basis of a material of an emission layer. Each of the subpixels of the electroluminescent display apparatuses includes a light emitting device for self-emitting light, and controls an emission amount of the light emitting device with a data voltage based on a gray level of image data to adjust luminance.

Electroluminescent display apparatuses can select an optical band suitable for a user input to change a luminance range implemented in a screen. To this end, the electroluminescent display apparatuses can include a plurality of optical bands which define different maximum luminance ranges.

However, because all optical bands use a black grayscale data voltage set with respect to a highest luminance band, a black margin is excessive in low luminance bands, and due to this, there can be a limitation where ghost mura may occur in implementing low luminance.

SUMMARY OF THE DISCLOSURE

To overcome the aforementioned limitations of the related art, the present disclosure can provide an electroluminescent display apparatus and a driving method thereof, in which black margins of optical bands are equal, thereby preventing ghost mura from occurring in implementing low luminance.

To achieve these objects and other advantages and in accordance with the purpose of the disclosure, as embodied and broadly described herein, an electroluminescent display apparatus can include a display panel including a plurality of pixels, and a luminance adjuster configured to select a target optical band corresponding to a digital brightness value from among a plurality of optical bands for differently controlling a maximum luminance of an image implemented in the display panel, and adjust a black grayscale data voltage corresponding to the target optical band, wherein the black grayscale data voltage is differently set in at least two of the plurality of optical bands.

A voltage interval up to a 1 grayscale data voltage from the black grayscale data voltage can be a black margin, and the black margin can be equal in the optical bands.

A plurality of optical bands can be independently provided for each real color implemented in the plurality of pixels, and the black grayscale data voltage can be differently set in each of the plurality of optical bands independently provided for each real color.

A voltage interval up to a 1 grayscale data voltage from the black grayscale data voltage can be a black margin, and the black margin can be equal in all optical bands regardless of a real color.

In another aspect of the present disclosure, provided is a driving method of an electroluminescent display apparatus including a display panel including a plurality of pixels. The driving method can include selecting a target optical band corresponding to a digital brightness value from among a plurality of optical bands for differently controlling a maximum luminance of an image implemented in the display panel, and adjusting a black grayscale data voltage corresponding to the target optical band, wherein the black grayscale data voltage is differently set in each of the optical bands.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE EMBODIMENTS

Figure 1:
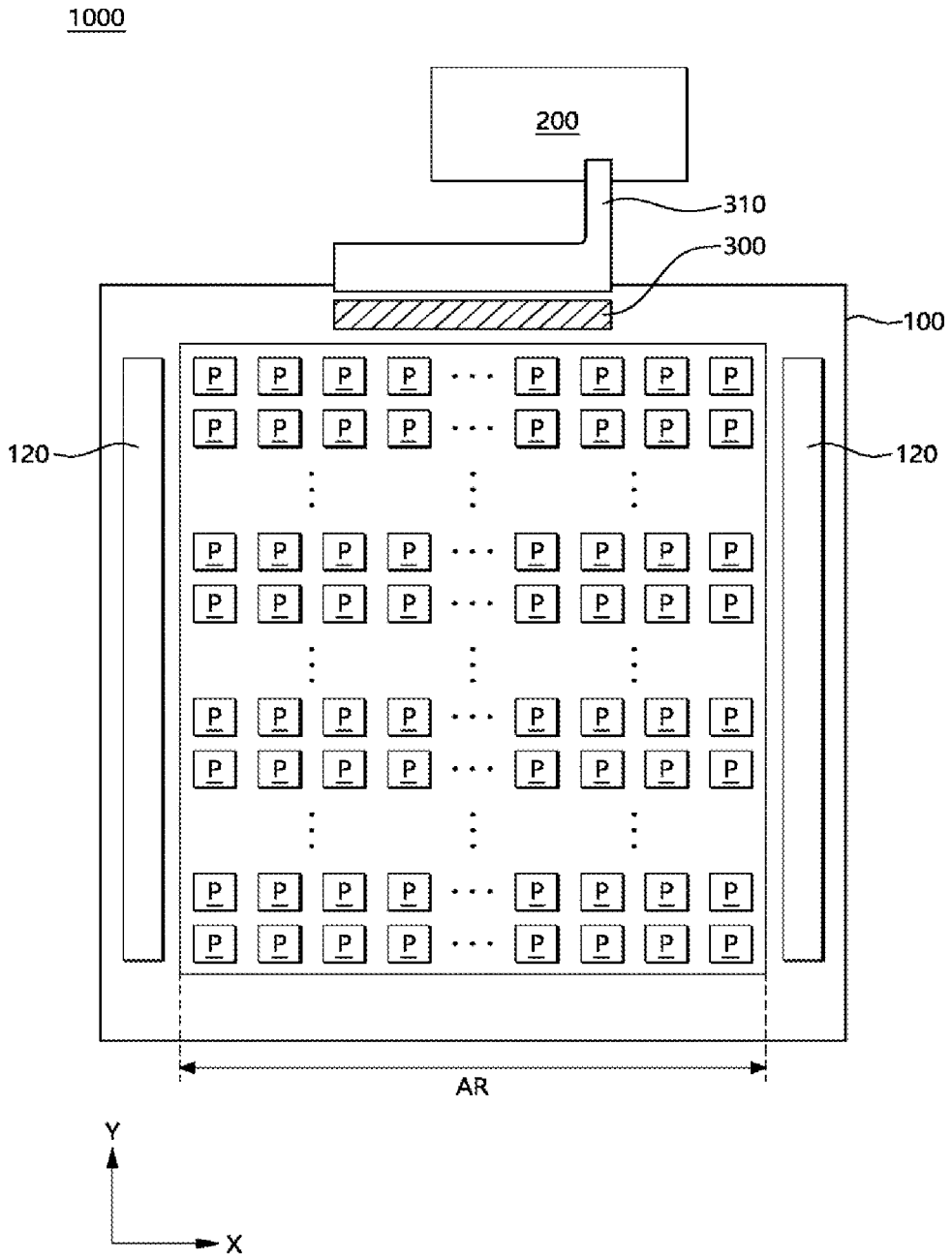
FIG. 1 is a block diagram illustrating an electroluminescent display apparatus according to an embodiment of the present disclosure.

Hereinafter, exemplary embodiments of the present disclosure will be described in detail with reference to the accompanying drawings. In the specification, in adding reference numerals for elements in each drawing, it should be noted that like reference numerals already used to denote like elements in other drawings are used for elements wherever possible. In the following description, when the detailed description of the relevant known function or configuration is determined to unnecessarily obscure the important point of the present disclosure, the detailed description will be omitted.

All components of each electroluminescent display apparatus according to all embodiments of the present disclosure are operatively coupled and configured.

Figure 2:
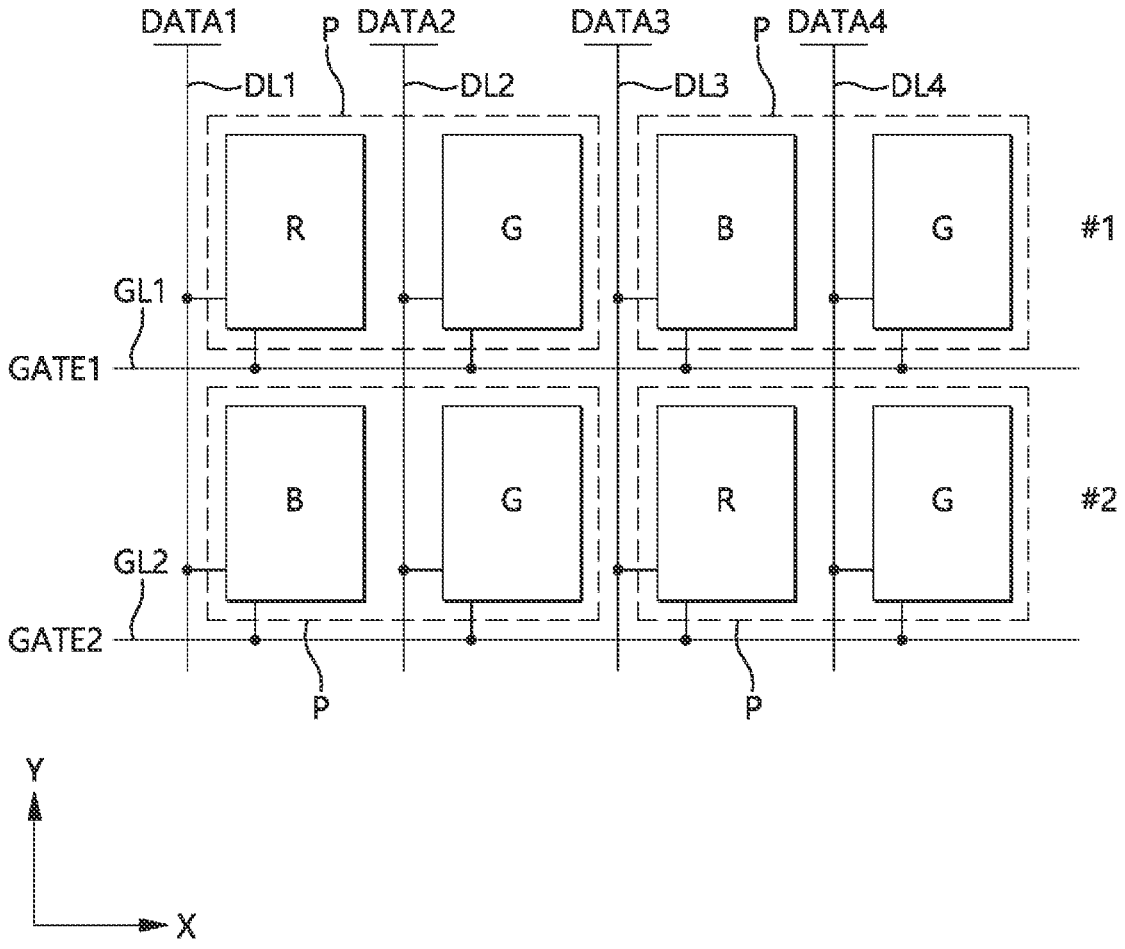
FIG. 2 is a diagram illustrating an example where pixels included in a display panel are arranged.
Figure 3:
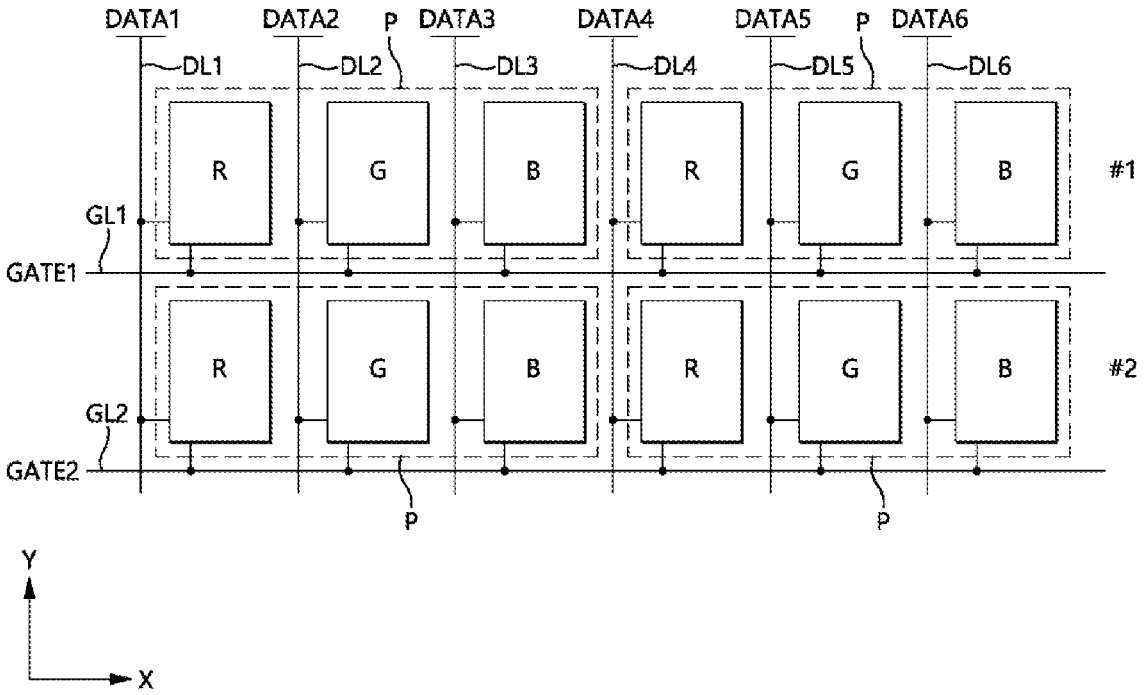
FIG. 3 is a diagram illustrating another example where pixels included in a display panel are arranged.
Figure 4:
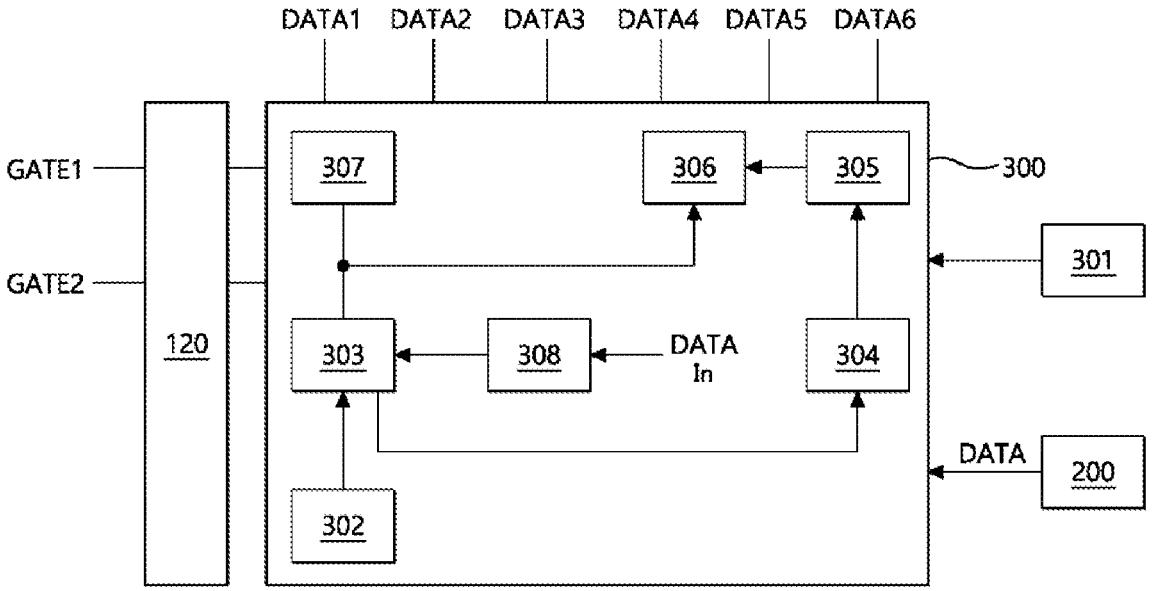
FIG. 4 is a block diagram illustrating a configuration of a drive integrated circuit (IC) illustrated in FIG. 1.

FIG. 1 is a block diagram illustrating an electroluminescent display apparatus according to an embodiment of the present disclosure. FIG. 2 is a diagram illustrating an example where pixels included in a display panel are arranged. FIG. 3 is a diagram illustrating another example where pixels included in a display panel are arranged. FIG. 4 is a block diagram illustrating a configuration of a drive integrated circuit (IC) illustrated in FIG. 1.

Referring to FIGS. 1 to 4, an electroluminescent display apparatus 1000 according to an embodiment of the present disclosure can include a display panel 100 and a plurality of display panel drivers 120 and 300. The display panel 100 can include a plurality of pixels P in a screen AR, and a plurality of gate lines GL1 to GLn and data lines DL1 to DLm, where n and m can each be a positive integer greater than 1.

The display panel drivers 120 and 300 can supply input image data to the pixels P of the screen AR to allow an image to be displayed on the screen AR. The display panel drivers 120 and 300 can include a gate driver 120 which supplies a gate signal to gate lines GL1 and GL2 of the display panel 100, a data driver 306 which converts image data into a voltage of a data signal (hereinafter referred to as a data voltage) and supplies data voltages to data lines DL1 to DL6 through data output channels, and a timing controller 303 which controls an operation timing of the data driver 306 and an operation timing of the gate driver 120. The data driver 306 and the timing controller 303 can be integrated into a drive integrated circuit (IC) 300.

The screen AR of the display panel 100 can include the data lines DL1 to DL6, the gate lines GL1 and GL2 which intersect with the data lines DL1 to DL6, and a pixel array where pixels P are arranged as a matrix type. The pixels P can be provided in the pixel array as a matrix type defined by the gate lines GL1 and GL2 and the data lines DL1 to DL6. The pixels P can display an image with data voltages applied thereto.

Each of the pixels P can include a plurality of subpixels so as to implement a color. The subpixels can include a red subpixel (hereinafter referred to as an R subpixel), a green subpixel (hereinafter referred to as a G subpixel), and a blue subpixel (hereinafter referred to as a B subpixel). A white subpixel can be further included in each pixel P. But the embodiments of the present disclosure are not limited thereto. Each subpixel can also include subpixels of other colors.

Each of the subpixels can include an internal compensation circuit which senses an electrical characteristic (for example, a threshold voltage) of a driving element to compensate for a gate voltage of the driving element.

The subpixels can configure a real color pixel P or a pentile pixel P. The pentile pixel P can drive two subpixels having different colors as one pixel P by using a predetermined pixel rendering algorithm as illustrated in FIG. 2, and thus, can implement a resolution which is higher than that of the real color pixel. The pixel rendering algorithm can compensate for insufficient color implementation in each subpixel by using a color of light emitted from an adjacent subpixel. In the example of FIG. 2, one pixel P composed of an R subpixel and a G subpixel, and another pixel P composed of a B subpixel and a G subpixel, can be alternatingly and repeatedly disposed adjacent to each other.

In the rear color pixel P, as illustrated in FIG. 3, one pixel P can be configured with R, G, and B subpixels. Such pixel P can be repeatedly disposed adjacent to each other.

When a resolution of the pixel array is n*m, the pixel array can include a n number of pixel columns and a m number of pixel rows intersecting with the pixel column. In FIGS. 2 and 3, #1 and #2 can represent numbers of pixel rows. The pixel column can include pixels P arranged in a Y-axis direction. The pixel row can include pixels P arranged in an X-axis direction. One horizontal period 1H can denote a time where one frame period is divided by the number of m pixel rows. The gate driver 120 can sequentially output a gate signal up to an $m^{th}$ pixel row from a first pixel row to perform progressive scan on the pixels P by row units. Each of subpixels of one pixel row can operate in the order of initialization, sensing, and data supply performed in one horizontal period.

The pixel array of the display panel 100 can be formed in a glass substrate, a metal substrate, or a plastic substrate. In a plastic panel, the pixel array can be formed in the plastic pixel, and thus, the plastic panel can be implemented as a flexible panel. The plastic panel can include a pixel array on an organic thin film attached on a back plate. A touch sensor array can be formed on the pixel array.

The back plate can be a polyethylene terephthalate (PET) substrate. An organic thin film can be formed on the back plate. The pixel array and the touch sensor array can be formed on the organic thin film. The back plate can prevent penetration of water into the organic thin film so that the pixel array is not exposed to humidity. The organic thin film can be a polyimide (PI) film substrate. A multi-layer buffer layer can be formed of an insulating material on the organic thin film. Lines for transferring power or a signal to the pixel array and the touch sensor array can be formed on the organic thin film.

The gate driver 120 can be mounted on a substrate of the display panel 100 along with the pixel array. The gate driver 120 directly provided on the substrate of the display panel 100 has been known as a gate in panel (GIP) circuit.

The gate driver 120 can be disposed in one bezel of a left bezel and a right bezel and can supply the gate signal to the gate lines GL1 and GL2 on the basis of a single feeding scheme. In the single feeding scheme, in FIG. 1, one of two gate drivers 120 may not be needed.

The gate driver 120 can be disposed in each of the left bezel and the right bezel and can supply the gate signal to the gate lines GL1 and GL2 on the basis of a double feeding scheme. In the double feeding scheme, the gate signal can be simultaneously applied at both ends of one gate line.

The gate driver 120 can be driven based on a gate timing signal supplied from the drive IC 300 by using a shift register and can supply gate signals GATE1 and GATE2 to the gate lines GL1 and GL2. The shift register can shift the gate signals GATE1 and GATE2, and thus, can sequentially supply the gate signals GATE1 and GATE2 to the gate lines GL1 and GL2. The gate signals GATE1 and GATE2 can include a scan signal and an emission control signal.

The drive IC 300 can output a gate timing signal for controlling the gate driver 120. The drive IC 300 can be connected to the data lines DL1 to DL6 through the data output channels and can supply data voltages Vdata to the data lines DL1 to DL6.

The drive IC 300, as illustrated in FIG. 4, can be connected to a host system 200, a first memory 301, and the display panel 100. The drive IC 300 can include a data calculator 308, the timing controller 303, and the data driver 306. The drive IC 300 can further include a second memory 302, a gamma compensation voltage generator 305, a power unit 304, and a level shifter 307.

The timing controller 303 can supply the data driver 306 with image data DATA received from the host system 200. The timing controller 303 can generate a gate timing signal for controlling the gate driver 120 and a source timing signal for controlling the data driver 306 to control an operation timing of each of the gate driver 120 and the data driver 306.

The level shifter 307 can receive gate timing signals from the timing controller 303 and can shift voltage levels of the gate timing signals. The gate timing signals can include a gate timing signal, such as a start pulse VST and a shift clock GCLK, and a gate voltage such as a gate on voltage VGL and a gate off voltage VGH. The start pulse VST and the shift clock GCLK can swing between the gate on voltage VGL and the gate off voltage VGH.

The level shifter 307 can shift a low level voltage of the gate timing signal, received from the timing controller 303, to the gate on voltage VGL and can shift a high level voltage of the gate timing signal, received from the timing controller 303, to the gate off voltage VGH. The level shifter 307 can output and supply the gate timing signal and the gate voltage VGH and VGL to the gate driver 120 through output channels.

The data calculator 308 can receive image data DATA and a display brightness value DBV from the host system 200 and can modulate the received image data DATA by using a predetermined image quality algorithm, thereby enhancing image quality. Also, the data calculator 308 can vary a data voltage Vdata on the basis of the display brightness value DBV to limit a maximum luminance of the pixels P. The data calculator 308 can include a data recovery unit which decodes compressed image data DATA to recover the compressed image data DATA, an optical compensator which adds a predetermined optical compensation value to the image data DATA, and a luminance adjuster which varies a black grayscale data voltage Vdata on the basis of the display brightness value DBV. The optical compensation value can be set to a value for compensating for a luminance of each image data on the basis of a luminance of a screen measured based on a camera image captured in a manufacturing process.

The data driver 306 can convert image data (a digital signal), received from the timing controller 303, into a gamma compensation voltage by using a digital-to-analog converter (DAC), thereby outputting the data voltage Vdata. The data voltage Vdata output from the data driver 306 can be supplied to the data lines DL1 to DL6 of the pixel array through an output buffer connected to a data channel of the drive IC 300.

The gamma compensation voltage generator 305 can divide the gamma reference voltage from the power unit 304 through a voltage division circuit to generate a grayscale-based gamma compensation voltage. The gamma compensation voltage can be an analog voltage where a voltage is set for each gray level of image data. The gamma compensation voltage output from the gamma compensation voltage generator 305 can be supplied to the data driver 306.

The power unit 304 can generate power needed for driving of the pixel array of the display panel 100, the gate driver 120, and the drive IC 300 by using a DC-DC converter. The DC-DC converter can include a charge pump, a regulator, a buck converter, and a boost converter. The power unit 304 can adjust a direct current (DC) input voltage from the host system 200 to generate DC voltages such as the gamma reference voltage, the gate on voltage VGL, the gate off voltage VGH, a pixel driving voltage ELVDD, a low level source voltage ELVSS, and an initialization voltage Vini.

The gamma reference voltage can be supplied to the gamma compensation voltage generator 305. The gate on voltage VGL and the gate off voltage VGH can be supplied to the level shifter 307 and the gate driver 120. A pixel power voltage such as the pixel driving voltage ELVDD, the low level source voltage ELVSS, and the initialization voltage Vini can be supplied to subpixels in common. Each of the subpixels can include a pixel circuit including a driving element DT and a light emitting device EL.

The initialization voltage Vini can be a voltage for initializing main nodes of the pixel circuit. The gate voltage can be set to VGH=8V and VGL=−7V and the pixel power can be set to VDD=4.6V, VSS=−2V to −3V, and Vini (or Vref)=−3V to −4V, but the present disclosure is not limited thereto. The data voltage Vdata can be set to Vdata=2V to 6V, but the present disclosure is not limited thereto.

The initialization voltage Vini can be set to a DC voltage which is lower than the data voltage Vdata and is lower than a threshold voltage of the light emitting device EL, and thus, can control emission of light from the light emitting device EL and can initialize the main nodes of the pixel circuit.

When power is input to the drive IC 300, the second memory 302 can store a compensation value, a register setting value, and an optical band-based black grayscale adjustment value received from the first memory 301. The compensation value can be applied to various algorithms for enhancing image quality. The compensation value can include an optical compensation value. The optical band-based black grayscale adjustment value can be selected based on the digital brightness value DBV input from the host system 200.

The register setting value can define a timing of a waveform and an operation of each of the data driver 306, the timing controller 303, the gamma compensation voltage generator 305, and the power unit 304 and an output voltage level of the power unit 304. The second memory 302 can include a static random access memory (SRAM).

The host system 200 can be one of a television (TV) system, a set-top box, a navigation system, a personal computer (PC), a home theater system, a mobile system, a wearable system, etc.

The mobile system as the host system 200 can be implemented with an application processor (AP). In the mobile system, the host system 200 can transfer input image data to the drive IC 300 through a mobile industry processor interface (MIPI). The host system 200 can be connected to the drive IC 300 through a flexible printed circuit (FPC) 310.

Figure 5:
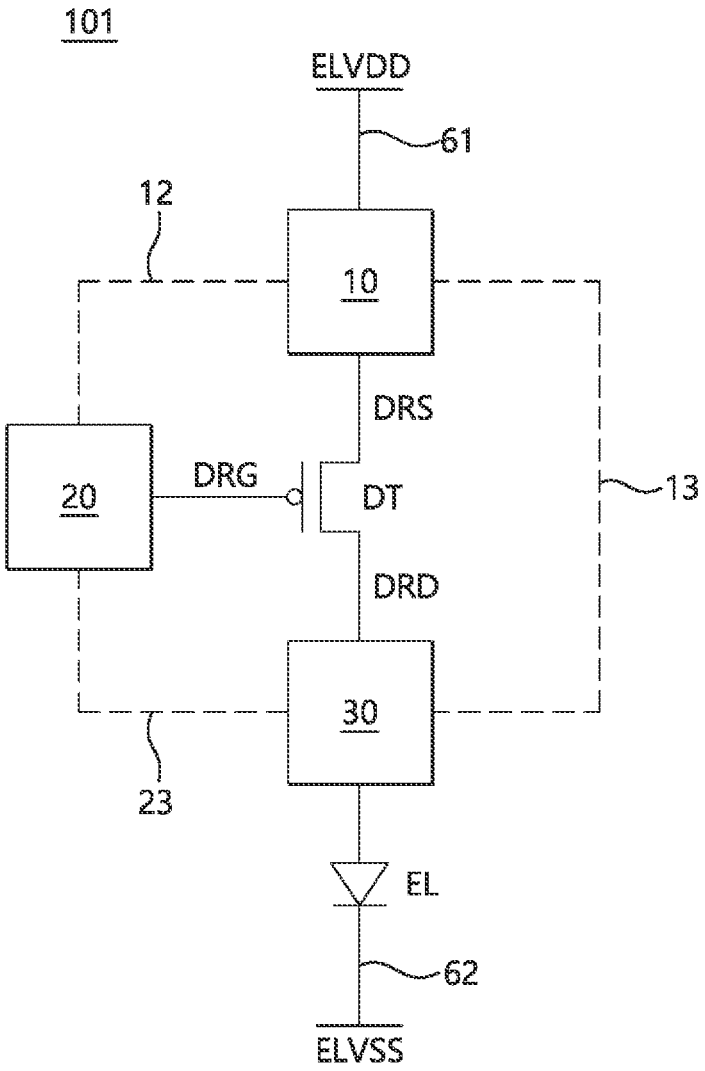
FIG. 5 is a diagram schematically illustrating a pixel circuit of each subpixel.

FIG. 5 is a diagram schematically illustrating a pixel circuit 101 of each subpixel. The configuration of the pixel circuit 101 can be used in any pixel circuit of the electroluminescent display apparatus discussed herein according to all embodiments of the present disclosure.

Referring to FIG. 5, the pixel circuit 101 can include first to third circuit units 10, 20, and 30 and first to third connection portions 12, 23, and 13. In the pixel circuit 101, one or more elements can be omitted or added.

The first circuit unit 10 can supply the pixel driving voltage ELVDD to the driving element DT. The driving element DT can be implemented with a transistor including a gate DRG, a source DRS, and a drain DRD. The second circuit unit 20 can charge the capacitor Cst connected to the gate DRG of the driving element DT and can hold a voltage of the capacitor Cst during one frame period. The third circuit unit 30 can supply the light emitting device EL with a current supplied from the pixel driving voltage ELVDD through the driving element DT, and thus, the current can be converted into light. Each of the first to third circuits 10, 20, and 30 can include an internal compensation circuit for compensating for a threshold voltage of the driving element DT. The third circuit unit 30 can be connected to a sensing unit which senses a threshold voltage or electrical characteristic variation of the driving element DT in real time.

The first connection portion 12 can connect the first circuit unit 10 to the second circuit unit 20. The second connection portion 23 can connect the second circuit unit 20 to the third circuit unit 30. The third connection portion 13 can connect the third circuit unit 30 to the first circuit unit 10. Each of the first connection portion 12, the second connection portion 23, and the third connection portion 12 can include one or more transistors and lines.

Figure 6:
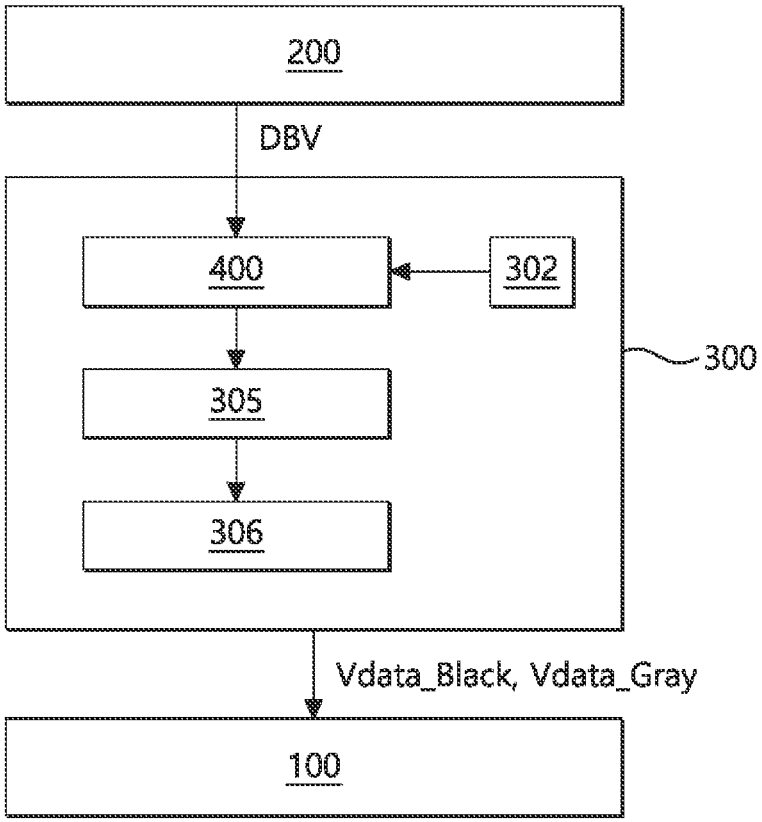
FIG. 6 is a diagram illustrating an overall circuit configuration for adjusting a black grayscale data voltage so as to be suitable for a target optical band.
Figure 7:
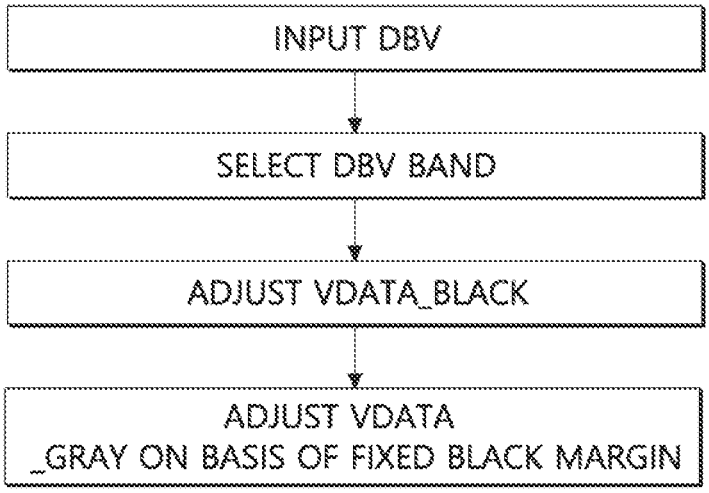
FIG. 7 is a diagram illustrating a method of adjusting a black grayscale data voltage corresponding to a target optical band.
Figure 8A:
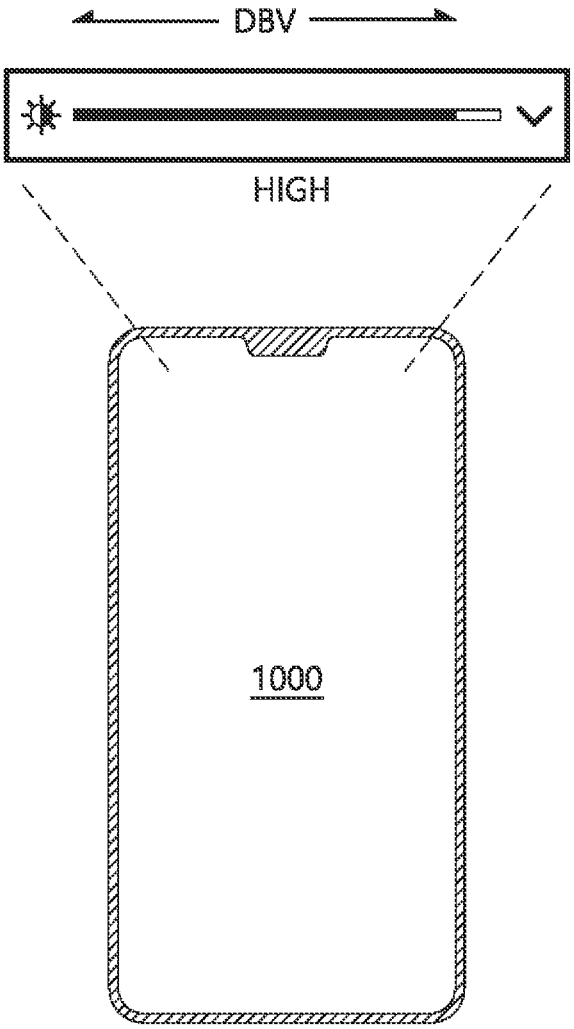
FIGS. 8A and 8B are diagrams illustrating an example of a digital brightness value input from a user.
Figure 8B:
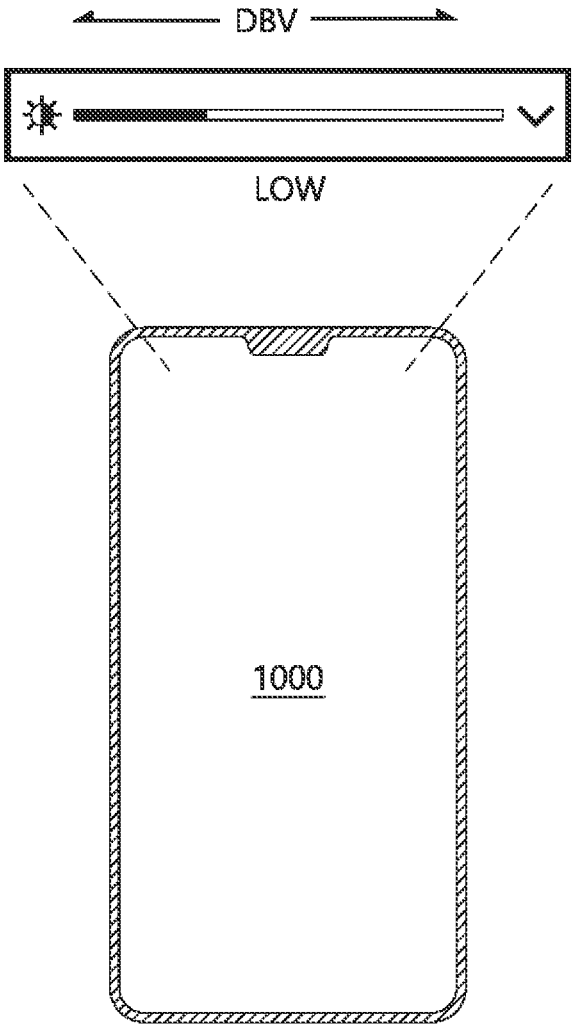
Figure 9:
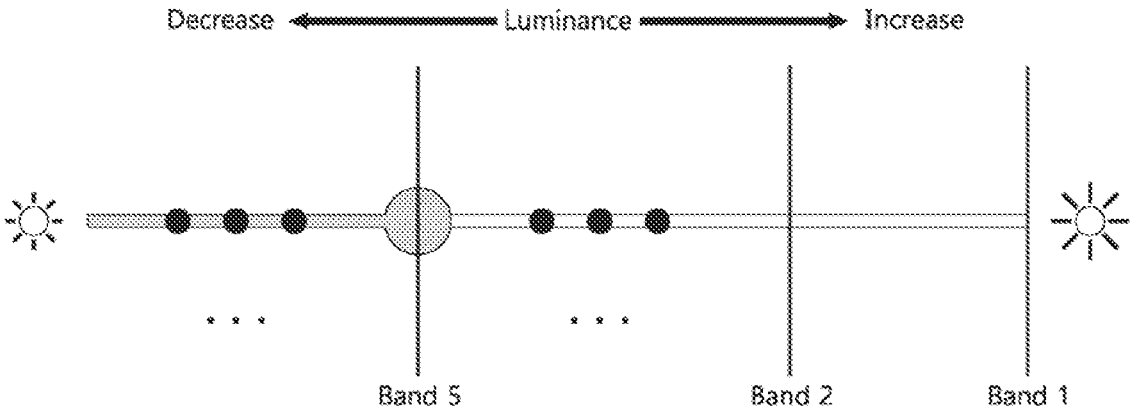
FIGS. 9 and 10 are diagrams illustrating examples of a plurality of optical bands corresponding to different digital brightness values.
Figure 10:
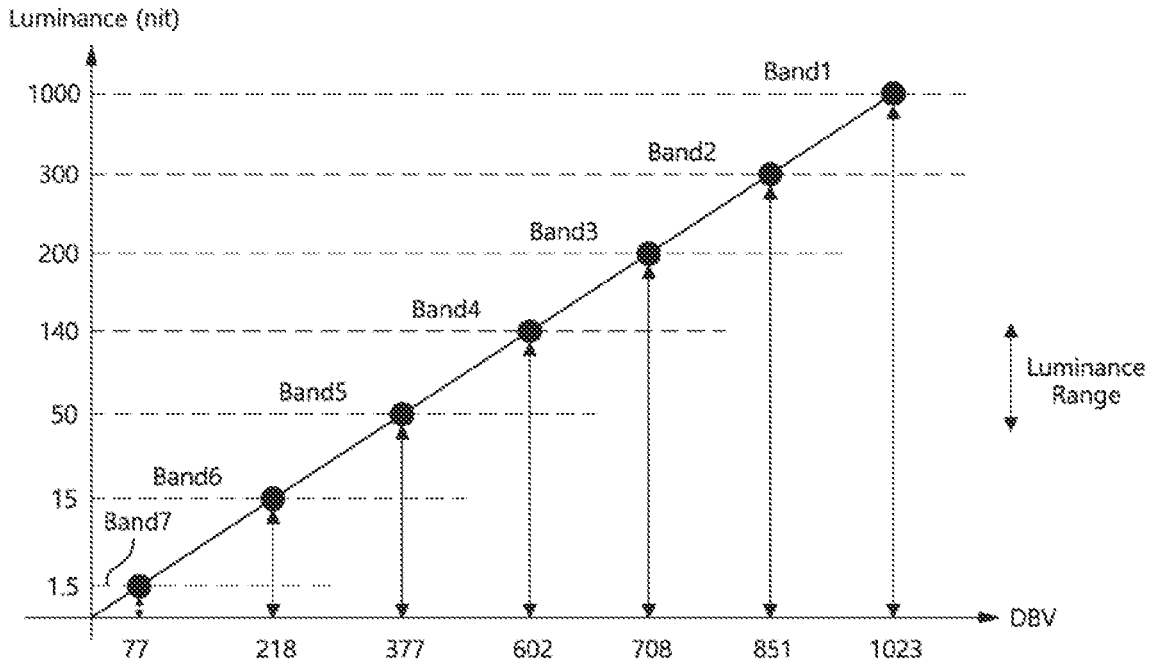

FIG. 6 is a diagram illustrating an overall circuit configuration for adjusting a black grayscale data voltage so as to be suitable for a target optical band. FIG. 7 is a diagram illustrating a method of adjusting a black grayscale data voltage corresponding to a target optical band. FIGS. 8A and 8B are diagrams illustrating an example of a digital brightness value input from a user. FIGS. 9 and 10 are diagrams illustrating examples of a plurality of optical bands corresponding to different digital brightness values.

Referring to FIGS. 6 and 7, the host system 200 can adjust a brightness mode on the basis of a user input or an illumination value of a peripheral environment.

For example, as illustrated in FIGS. 8A and 8B, the host system 200 can transfer the digital brightness value DBV, corresponding to the user input, to the drive IC 300. The host system 200 can obtain an illumination value from an illumination sensor and can transfer the digital brightness value DBV, which is proportional to the illumination value, to the drive IC 300. Here, the digital brightness value DBV can define a maximum luminance of the brightness mode.

The data calculator 308 of the drive IC 300 can include a luminance adjuster 400 for limiting a maximum luminance of subpixels on the basis of the digital brightness value DBV. The luminance adjuster 400 can generate luminance control information for adjusting a data voltage Vdata on the basis of an optical band-based black grayscale adjustment value stored in the second memory 302.

The optical band can be provided in plurality to correspond to a plurality of digital brightness values DBV input from the host system 200. For example, as illustrated in FIGS. 9 and 10, the optical band can include first to seventh DBV bands Band 1 to Band 7 corresponding to different digital brightness values DBV. But embodiments of the present disclosure are not limited thereto. For example, at least two DBV bands could be provided, or more than 7 DBV bands could be provided.

The first DBV band Band 1 can limit a maximum luminance to 1000 nit on the basis of a representative digital brightness value DBV of 1,023, the second DBV band Band 2 can limit a maximum luminance to 300 nit on the basis of a representative digital brightness value DBV of 851, the third DBV band Band 3 can limit a maximum luminance to 200 nit on the basis of a representative digital brightness value DBV of 708, and the fourth DBV band Band 4 can limit a maximum luminance to 140 nit on the basis of a representative digital brightness value DBV of 602. The fifth DBV band Band 5 can limit a maximum luminance to 50 nit on the basis of a representative digital brightness value DBV of 377, the sixth DBV band Band 6 can limit a maximum luminance to 15 nit on the basis of a representative digital brightness value DBV of 218, and the seventh DBV band Band 7 can limit a maximum luminance to 1.5 nit on the basis of a representative digital brightness value DBV of 77.

The luminance adjuster 400 can receive the digital brightness value DBV from the host system 200 to select a target optical band corresponding to the digital brightness value DBV, and thus, can determine a maximum luminance range of the brightness mode. When a digital brightness value DBV arranged between adjacent representative digital brightness values DBV is input, the luminance adjuster 400 can interpolate the adjacent representative digital brightness values DBV to select the target optical band.

The luminance adjuster 400 can read a black grayscale adjustment value, which is suitable for the target optical band, from the second memory 302 and can generate luminance control information for adjusting a black grayscale data voltage Vdata Black on the basis of the black grayscale adjustment value, thereby fitting a black margin of the target optical band to a fixed value.

The luminance adjuster 400 can further generate luminance control information for adjusting a high grayscale data voltage Vdata_Gray on the basis of the fixed black margin, and thus, can implement a luminance range of the target optical band.

The data driver 306 of the drive IC 300 can be supplied with the gamma compensation voltage from the gamma compensation voltage generator 305 and can be supplied with luminance control information from the luminance adjuster 400. The data driver 306 can correct the gamma compensation voltage on the basis of the luminance control information and can map a corrected gamma compensation voltage to digital image data to output the black grayscale data voltage Vdata Black and the high grayscale data voltage Vdata_Gray to the display panel 100. The high grayscale data voltage Vdata_Gray can include all of 1 to highest grayscale data voltages.

Figure 11:
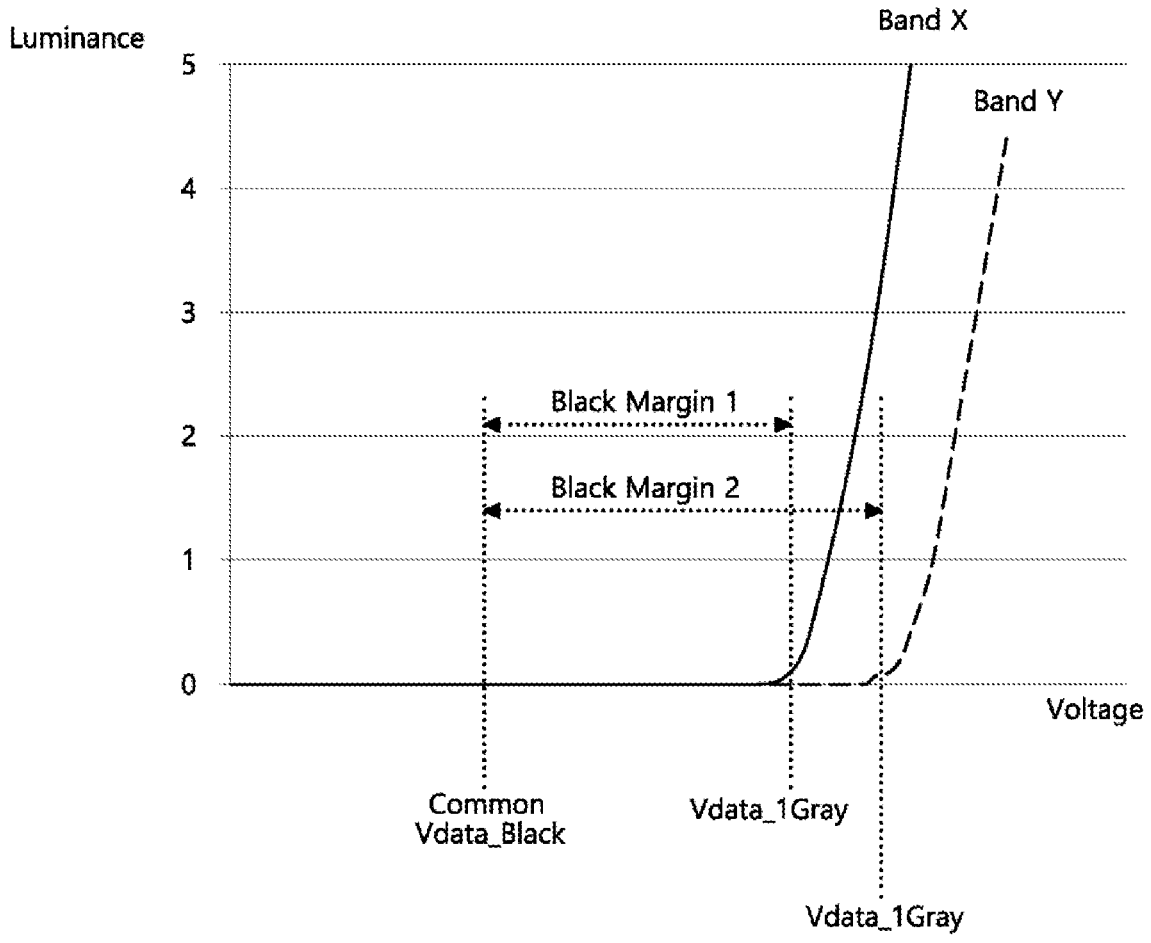
FIG. 11 is a diagram illustrating an example where black grayscale data voltages are identically set in all optical bands, in a comparative example of the present disclosure.
Figure 12:
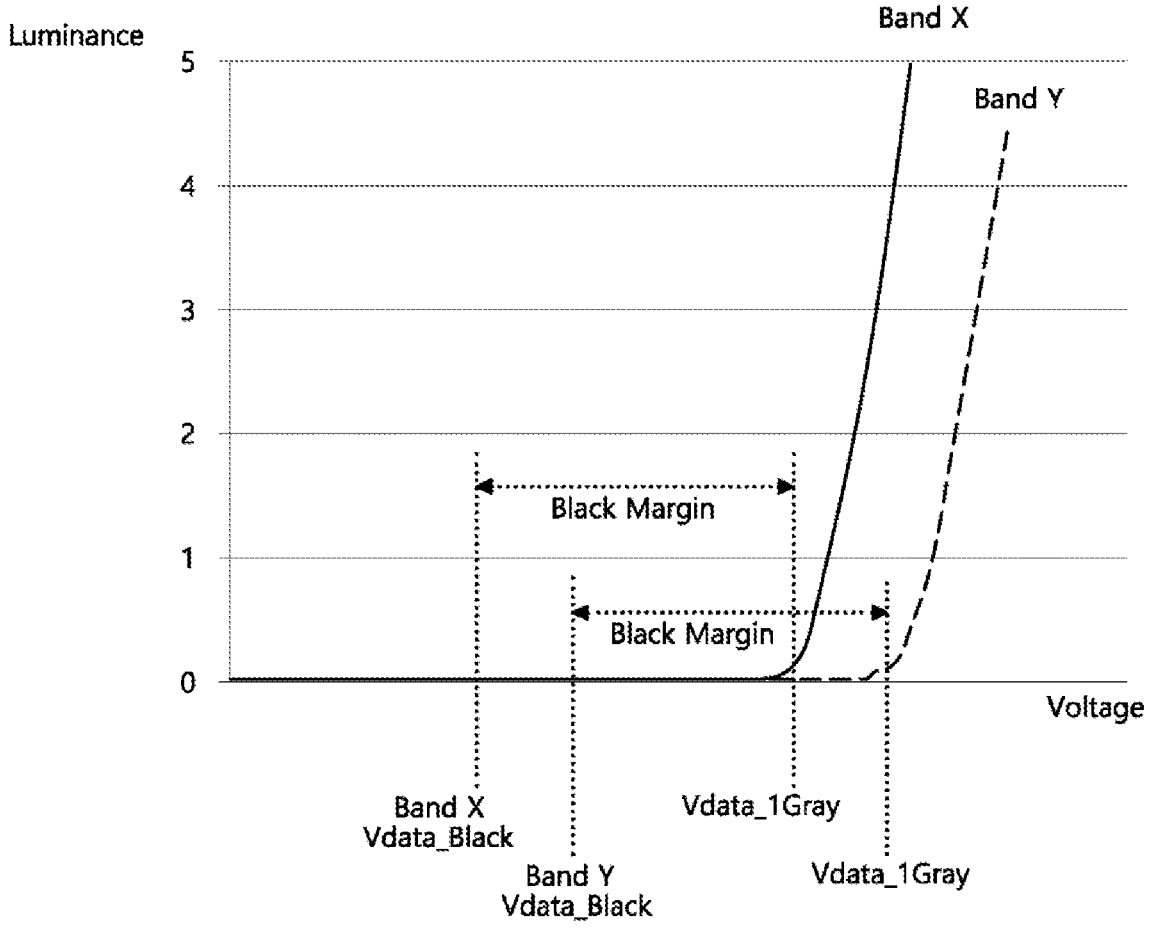
FIG. 12 is a diagram illustrating an example where black grayscale data voltages are differently set in each of optical bands, in an embodiment of the present disclosure.

FIG. 11 is a diagram illustrating an example where black grayscale data voltages are identically set in all optical bands, in a comparative example of the present disclosure. FIG. 12 is a diagram illustrating an example where black grayscale data voltages are differently set in each of optical bands, in an embodiment of the present disclosure.

In the comparative example of FIG. 11, because all optical bands use the same black grayscale data voltage Common Vdata Black set with respect to a highest luminance band Band X, a black margin can be excessive in a low luminance band Band Y. For example, because the black margin is based on the same black grayscale data voltage Common Vdata Black, a black margin 2 of the low luminance band Band Y can be greater than a black margin 1 of the highest luminance band Band X. When the black margin is excessive in the low luminance band Band Y, low luminance can be implemented in a low brightness mode, and in this case, ghost mura may occur.

On the other hand, in the embodiment of FIG. 12, black grayscale data voltages Vdata Black can be differently set in optical bands so that black margins are equal in all of the optical bands. A black grayscale data voltage Vdata Black of Band Y of the low luminance band Band Y can be set to be higher than a black grayscale data voltage Vdata Black of Band X of the highest luminance band Band X, and the black margin of the highest luminance band Band X can be equal to the black margin of the low luminance band Band Y. In the highest luminance band Band X, a black margin can be a first voltage interval between a black grayscale data voltage Vdata Black of Band X and a 1 grayscale data voltage Vdata_1Gray of Band X. In the low luminance band Band Y, a black margin can be a second voltage interval between a black grayscale data voltage Vdata Black of Band Y and a 1 grayscale data voltage Vdata_1Gray of Band Y. And the first voltage interval can be equal to the second voltage interval.

Therefore, a limitation in FIG. 11 can be addressed where ghost mura may occur because a black margin is excessive in the low luminance band Band Y.

Figure 13:
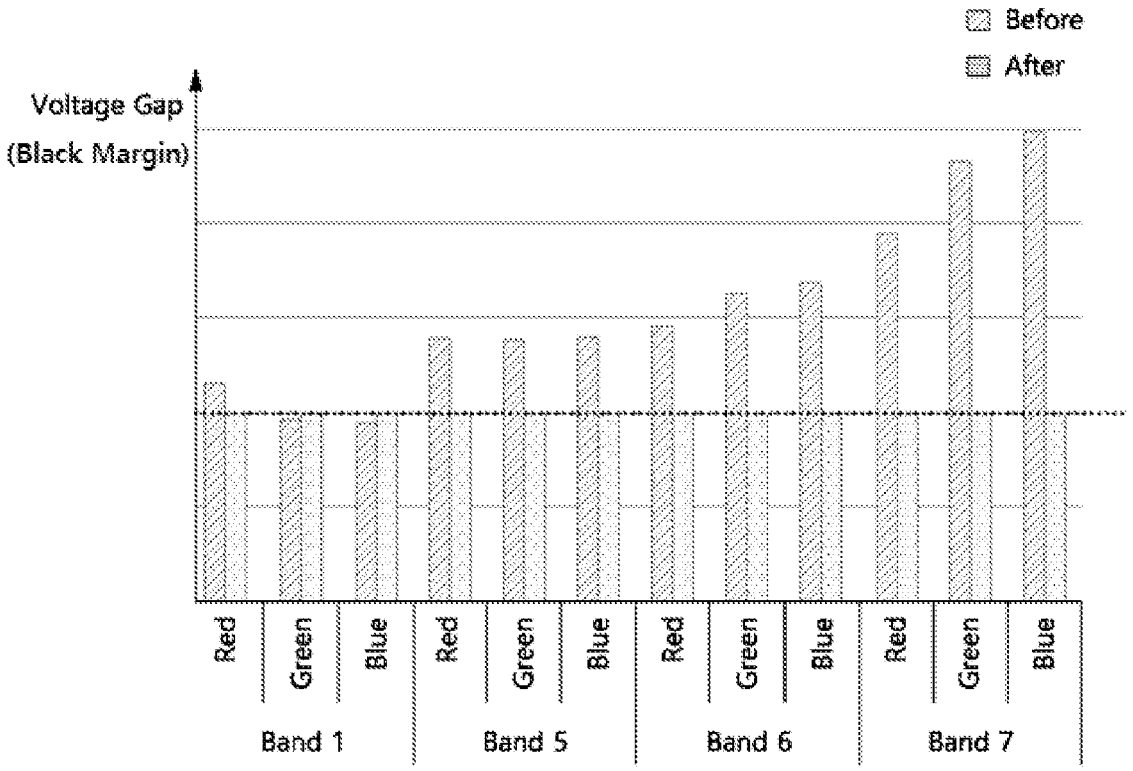
FIG. 13 is a diagram illustrating an example where black margins are equal in all optical bands regardless of a real color, in an embodiment of the present disclosure.

FIG. 13 is a diagram illustrating an example where black margins are equal in all optical bands regardless of a real color, in an embodiment of the present disclosure. In FIG. 13, a graph shown by an obliquely-striped pattern can represent black margins where technology of FIG. 11 is applied to real color-based optical bands. In FIG. 13, a graph shown by a dotted pattern can represent black margins where technology of FIG. 12 is applied to real color-based optical bands.

Referring to a dotted-pattern graph (the present embodiment) of FIG. 13, black grayscale data voltages can be differently set in independent optical bands for each of R, G, and B real colors. Even in this case, a voltage interval up to a 1 grayscale data voltage from a black grayscale data voltage can be a black margin. The black margin can be equal in all optical bands regardless of the R, G, and B real colors.

Therefore, in the independent optical bands for each of the R, G, and B real colors, the problem in FIG. 11 can also be solved where ghost mura can occur because the black margin is excessive in the low luminance band.

The embodiments of the present disclosure can realize the following effects.

According to the embodiments of the present disclosure, black margins of all optical bands can be equal based on a black grayscale data voltage which is differently set for each optical band, and thus, a limitation where ghost mura can occur because a black margin is excessive in a low luminance band can be addressed.

The effects according to the present disclosure are not limited to the above examples, and other various effects can be included in the specification.

While the present disclosure has been particularly shown and described with reference to exemplary embodiments thereof, it will be understood by those of ordinary skill in the art that various changes in form and details can be made therein without departing from the spirit and scope of the present disclosure as defined by the following claims.

What is claimed is:

1. An electroluminescent display apparatus comprising:
a display panel including a plurality of pixels; and
a luminance adjuster configured to:
select a target optical band corresponding to a digital brightness value from among a plurality of optical bands for differently controlling a maximum luminance of an image implemented in the display panel, and
adjust a black grayscale data voltage corresponding to the target optical band,
wherein the black grayscale data voltage is differently set in at least two of the plurality of optical bands, and
wherein the black grayscale data voltage is set so that a black grayscale data voltage of a lower luminance band is higher than a black grayscale data voltage of a higher luminance band.

2. The electroluminescent display apparatus of claim 1, wherein the black grayscale data voltage is differently set in each of the plurality of optical bands.

3. The electroluminescent display apparatus of claim 1, wherein a black margin is defined as a voltage interval from the black grayscale data voltage up to a 1 grayscale data voltage, and
the black margin is equal in at least two of the plurality of optical bands.

4. The electroluminescent display apparatus of claim 3, wherein the black margin is equal in the plurality of optical bands.

5. The electroluminescent display apparatus of claim 1, wherein a plurality of optical bands are independently provided for each real color implemented in the plurality of pixels, and
the black grayscale data voltage is differently set in at least two of the plurality of optical bands independently provided for each real color.

6. The electroluminescent display apparatus of claim 5, wherein the black grayscale data voltage is differently set in each of the plurality of optical bands independently provided for each real color.

7. The electroluminescent display apparatus of claim 6, wherein a black margin is defined as a voltage interval from the black grayscale data voltage up to a 1 grayscale data voltage, and
the black margin is equal in at least two of all the plurality of optical bands regardless of a real color.

8. The electroluminescent display apparatus of claim 7, wherein the black margin is equal in all of the plurality of optical bands regardless of a real color.

9. The electroluminescent display apparatus of claim 1, wherein the digital brightness value corresponds to a user input, or is proportional to an illumination value of a peripheral environment.

10. The electroluminescent display apparatus of claim 1, wherein the plurality of optical bands include at least seven optical bands.

11. The electroluminescent display apparatus of claim 1, wherein the luminance adjuster configured to:
in response to receiving an input to decrease the maximum luminance of the display panel, shift the black grayscale data voltage by a predetermined positive amount.

12. A driving method of an electroluminescent display apparatus including a display panel including a plurality of pixels, the driving method comprising:
selecting a target optical band corresponding to a digital brightness value from among a plurality of optical bands for differently controlling a maximum luminance of an image implemented in the display panel; and
adjusting a black grayscale data voltage corresponding to the target optical band,
wherein the black grayscale data voltage is differently set in each of the plurality of optical bands, and
wherein the black grayscale data voltage is set so that a black grayscale data voltage of a lower luminance band is higher than a black grayscale data voltage of a higher luminance band.

13. The driving method of claim 12, wherein a black margin is defined as a voltage interval from the black grayscale data voltage up to a 1 grayscale data voltage, and
the black margin is equal in the plurality of optical bands.

14. The driving method of claim 12, wherein a plurality of optical bands are independently provided for each real color implemented in the plurality of pixels, and
the black grayscale data voltage is differently set in each of the plurality of optical bands independently provided for each real color.

15. The driving method of claim 14, wherein a black margin is defined as a voltage interval from the black grayscale data voltage up to a 1 grayscale data voltage, and the black margin is equal in all of the plurality of optical bands regardless of a real color.

16. The driving method of claim 12, wherein the plurality of optical bands include at least seven optical bands.

17. The driving method of claim 12, further comprising:

in response to receiving an input to decrease the maximum luminance of the display panel, shifting the black grayscale data voltage by a predetermined positive amount.

18. A method of controlling a display apparatus, the method comprising:

displaying, by a display panel in the display apparatus, an image based on a first maximum luminance and a first black grayscale data voltage corresponding to a first digital brightness value; and in response to receiving a second digital brightness value for reducing the first maximum luminance, increasing a black grayscale voltage of the display panel from the first black grayscale data voltage to a second black grayscale data voltage corresponding to the second digital brightness value, wherein the first digital brightness value corresponds to a brighter luminance than the second digital brightness value, and the second black grayscale data voltage is greater than the first black grayscale data voltage.

19. The method of claim 18, wherein a first black margin is defined as a voltage interval from the first black grayscale data voltage up to a 1 grayscale data voltage, wherein a second black margin is defined as a voltage interval from the second black grayscale data voltage up to the 1 grayscale data voltage, and wherein the first black margin for corresponding to the first digital brightness value is equal to the second black margin for corresponding to the second digital brightness value.

20. The method of claim 18, wherein the first digital brightness value and the second digital brightness value are based on a user input or a sensed illumination value of a peripheral environment around the display apparatus.

* * * * *